United States Patent [19]

Van Housen

[11] 4,245,840

[45] Jan. 20, 1981

[54] RESISTIVE EXERCISE DEVICE

[76] Inventor: Jay W. Van Housen, 617 Gerecke, Norfolk, Nebr. 68701

[21] Appl. No.: 859,070

[22] Filed: Dec. 9, 1977

[51] Int. Cl.[3] ..... A63B 21/02

[52] U.S. Cl. ..... 272/137; 24/115 H

[58] Field of Search ..... 272/137, 142, 143, 135, 272/DIG. 4, 118, 119, 126; 128/134, 31; 2/326, 328, 327; 24/115 H, 49 S; 273/188 R

[56] References Cited

U.S. PATENT DOCUMENTS

| | | | |
|---|---|---|---|
| 418,257 | 12/1889 | Whitely | 272/136 |
| 546,568 | 9/1895 | Whitely | 24/115 H |
| 554,636 | 2/1896 | Hulsmann | 272/142 |
| 843,478 | 2/1907 | Müller | 272/139 |
| 1,340,455 | 5/1920 | Merritt | 2/328 X |
| 3,743,280 | 7/1973 | Martinez | 272/126 |
| 4,023,808 | 5/1977 | Hebert | 272/137 |
| 4,033,580 | 7/1977 | Paris | 272/142 X |
| 4,057,246 | 11/1977 | Wilson | 272/137 |

FOREIGN PATENT DOCUMENTS

| | | | |
|---|---|---|---|
| 831305 | 5/1938 | France | 272/137 |
| 1249617 | 11/1960 | France | 272/137 |
| 2305917 | 10/1976 | France | 272/116 |

*Primary Examiner*—William R. Browne

*Attorney, Agent, or Firm*—William D. West

[57] ABSTRACT

A resilient exercising device utilizing two highly elastic members and having handles at first ends of the members for the use of the hands and loops at the second ends of the members for the use of the feet is disclosed. An adjustable clip connector is provided to slidably connect and vary the lengths and the tension of the exercising device.

6 Claims, 20 Drawing Figures

RESISTIVE EXERCISE DEVICE

BACKGROUND OF THE INVENTION

With the increased awareness by people of all ages of the benefit of regular physical exercise, a need has existed for a simple, compact exercising device which can be used by both men and women to increase their muscle tone, help promote good health, improve coordination, and aid in controlling weight.

Many personal exercise devices are currently available. Some exercise devices are of the type requiring repetitive body motion and using pulley assemblies. There are also many isometric devices and other resistive devices available. In addition, there exists an assortment of resilient exercising devices such as the well known chest expander and other devices utilizing multiple metal coil springs or elastic cords. Generally, the devices that are available are designed to promote muscle building and are not designed for a universal exercise program for both men and women.

The value of repetitive exercises with a resistive device is well known and health clubs, schools, Y.M.-C.A.'s, and other recreational organizations have invested heavily in weight lifting equipment, weight training machines, wall mounted weight and pulley exercising devices, as well as numerous other resistive machines and apparatus. The use of such exercising devices not only augments the exercise program of those who engage in regular sports activities, such as running, hand ball, tennis, or swimming, but also the exercising devices are used by those who lack the time, space or money to engage in regular sports activitites.

Consequently, the need has long existed for a personal home exercise device that is inexpensive, allows repetitive body motions, tones and shapes the muscles, and is adjustable for universal application.

One elastic type exercising device that meets some, but not all of the above requirements, is disclosed in U.S. Pat. No. 4,033,580 to Paris. The Paris invention is apparently designed primarily as an aid in building muscle size and does not have the adjustable features necessary to accomodate exercises for men and women of all ages.

Another elastic type exercising device is disclosed in U.S. Pat. No. 3,807,730 to Dalton et al. This device has limited applications as it primarily is to be used only by gripping with the hands.

Another elastic type exercising device is disclosed in U.S. Pat. No. 4,026,549 to Gunn. The Gunn patent discloses a portable elastic type exercising device which also is adjustable. Unfortunately, the Gunn invention does not allow the user to exercise more than a limited muscle group, namely the upper body.

The instant invention, however, is directed to an improved resilient exercising device which does not have the shortcomings of the prior art and yet meets the need for a simple, inexpensive, easy to use, adjustable, personal exercise device.

SUMMARY OF THE INVENTION

As a need exists for a simple and inexpensive exercise device for use at home or office to both men and women of all ages, it is a desired object of the invention to provide such an exercising device.

Another object of the invention is to provide a resilient type exercising device which can be used for shaping and maintaining muscle tone by the use of repetitive body motion.

Another object of the invention is to provide an exercising device that allows the user wide range of exercises for a wide variety of muscle groups.

A still further object of the invention is to provide an adjustable elastic type exercising device utilizing a resilient material to produce a superior adjustable expander type home exercise device.

A still further object of the invention is to provide a portable, compact and easily used personal exercise device.

DESCRIPTION OF THE PREFERRED EMBODIMENTS

Figure 1:
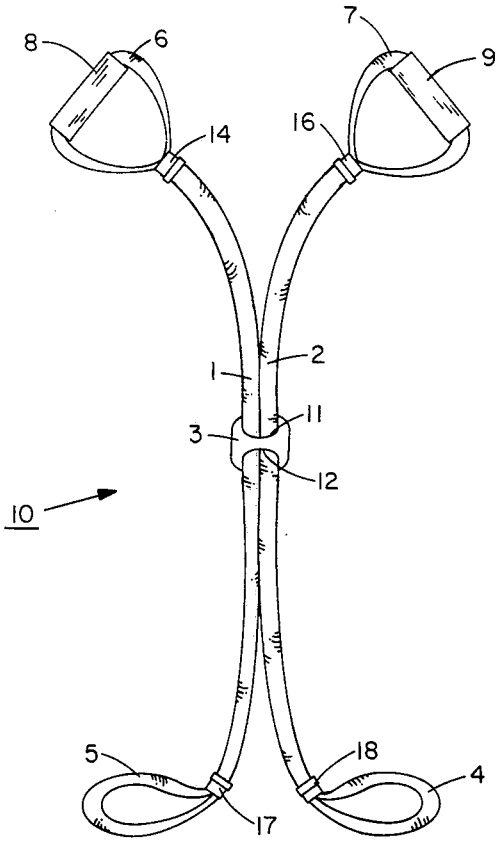
FIG. 1 is a plan view showing the resilient exercising device.
Figure 2:
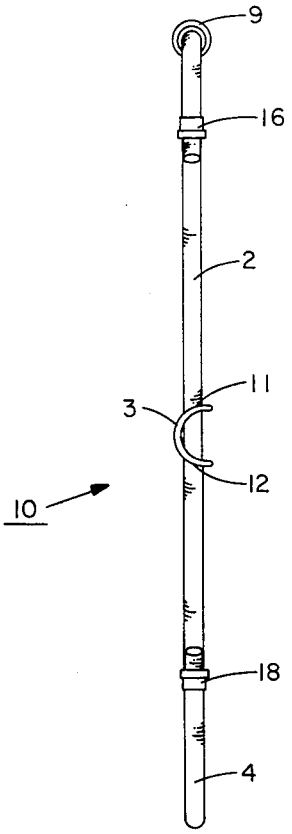
FIG. 2 is a side elevational view thereof.
Figure 3:
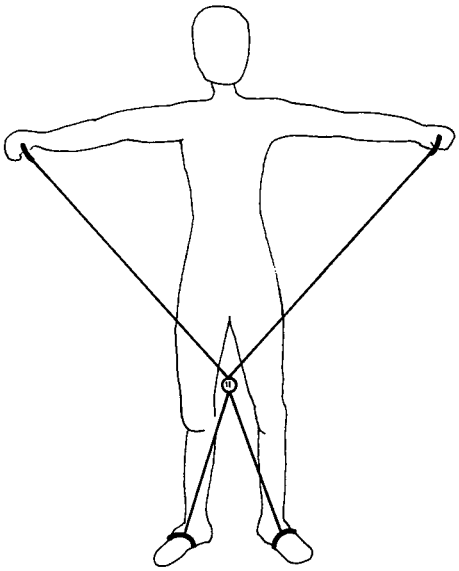
FIG. 3 illustrates one exercise to be performed with the device, the exercise allowing the user to raise the arms and thereby strengthen and shape the upper torso.
Figure 4:
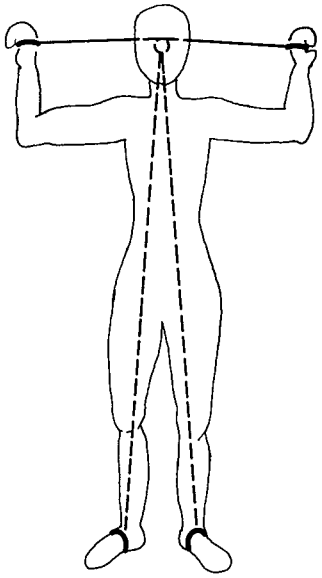
FIG. 4 illustrates the performance of another exercise employing the invention where it can be seen that the adjustable clip is moved upward to adjust the tension and direction of the device for the use in developing the particular muscle groups involved.
Figure 5:
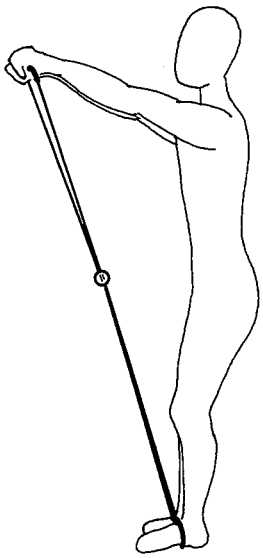
FIG. 5 illustrates an exercise utilizing the device to shape and firm the deltoid region of the upper back.
Figure 6:
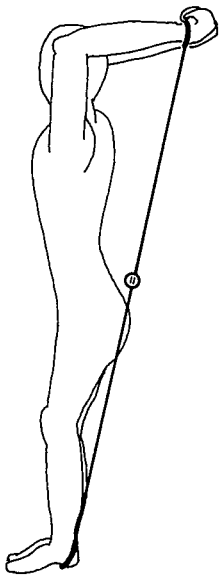
FIG. 6 illustrates an exercise utilizing the device to strengthen and shape the lower triceps and pectoral muscles.
Figure 7:
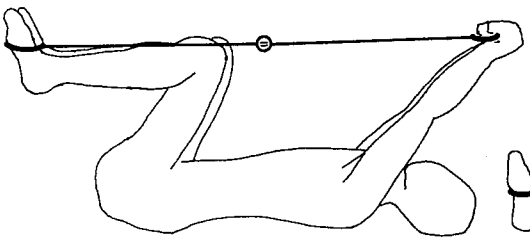
FIG. 7 illustrates an exercise utilizing the device to firm the abdominal region.

Referring now to FIGS. 1 and 2, which illustrates the preferred form of the resilient exercise device it can be seen that a first strap 1 and a second strap 2 of highly resilient elastic material are joined by the use of an adjustable connector clip 3. Two of the adjacent free ends of first strap 1 and second strap 2 are formed into loops 5 and 4 respectively, and affixed thereto by clamps 18 and 17. The other two adjacent ends free ends 6 and 7 of the first strap 1 and second strap 2 are formed into handles by passing the elastic material through a hollow core tube 8 and 9 and are affixed to the main body of the first strap 1 and second strap 2 by clamps 14 and 16. Thus joined, the device 10 exhibits two straps 1 and 2 of resilient material joined together by a slidably adjustable clip 3. Each strap 1 and 2 of resilient material thus has a hand hold 8 and 9 formed at one end and a foot hold 5 and 4 formed at the other end.

The slidably adjustable clip 3 may be moved the length of the exercising device 10 along either resilient strap 1 or 2 according to the desire of the user. When the clip 3 is depressed so as to be moved to the correct or desired position, tension on either the hand hold portions 8 and 9 or the foot hold portions 4 and 5 of the device 10 will bind the clip 3 by the use of friction. Thus held the clip 3 maintains the proper position thereby adjusting the tension and length of the motion of the device 10.

Referring now to FIGS. 1 and 2 the slidable adjustable clip 3 depicted is of a semi-rigid material formed into a semi-circularly bent disc as shown in FIG. 2. First strap 1 and second strap 2 of the exercise device pass through the holes 11 and 12 respectfully in the adjustable clip 3 thereby ensuring proper operation of the adjustable feature.

Referring now to FIGS. 3 through 20 wherein various exercises are illustrated using the device. It can readily be seen that the adjustable feature plays an extremely important role in the performance of exercises depicted in FIGS. 3, 4, 8, 9, 14, 15, 17, 18. The other exercises while not dependent on the adjustable feature show the wide range of exercises which can be accomplished using the device 10.

In use, the device 10 is generally grasped by the handles 8 and 9 having a hollow broad gripping surface and the feet are placed in the loops 4 and 5 formed directly from the resilient material.

Figure 8:
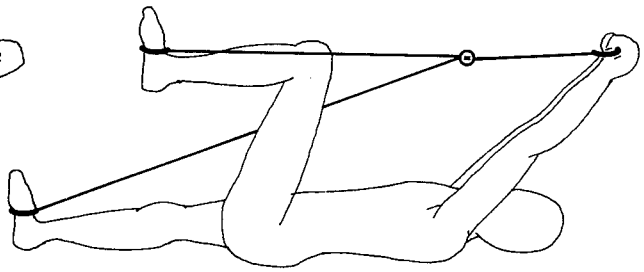
FIG. 8 illustrates an exercise utilizing the device designed to shape and firm the calves and hip area.
Figure 9:
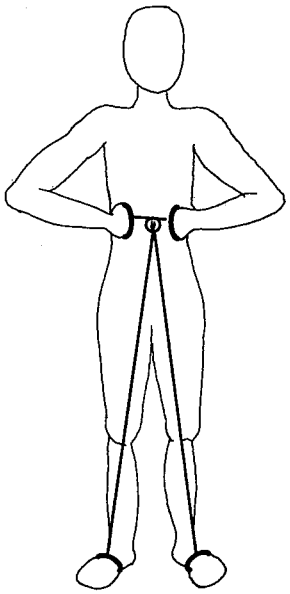
FIG. 9 illustrates an exercise utilizing the device designed to shape and firm the upper back.
Figure 10:
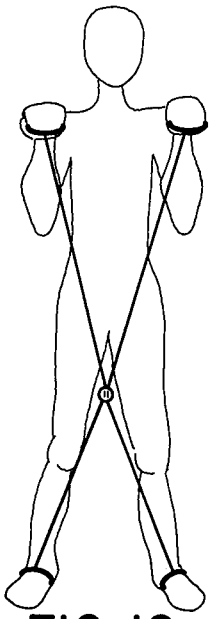
FIG. 10 illustrates an exercise utilizing the device to firm and shape the lower back region.
Figure 11:
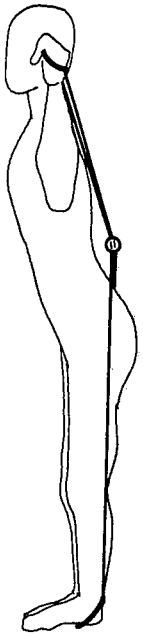
FIG. 11 illustrates an exercise utilizing the device to firm and shape the waist and abdominal areas.
Figure 12:
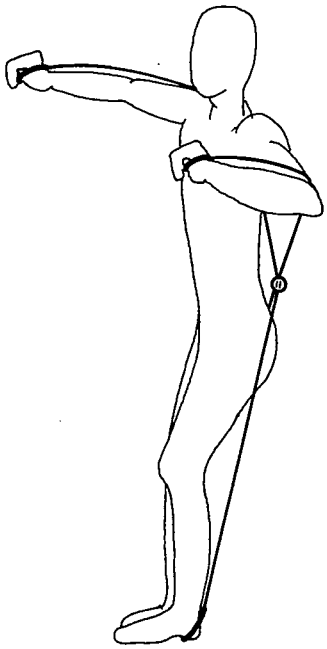
FIG. 12 illustrates an exercise utilizing the device to firm and shape the triceps and upper shoulder area muscles.
Figure 13:
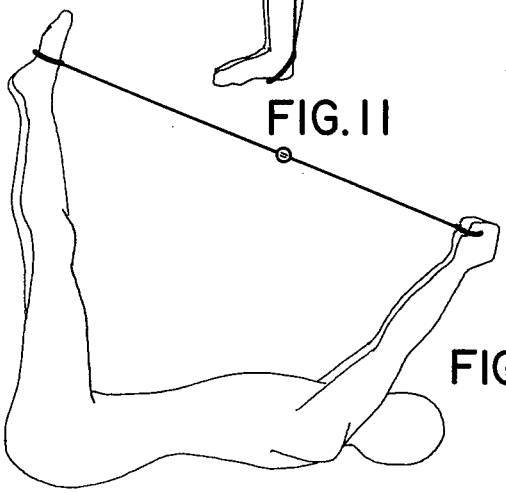
FIG. 13 illustrates an exercise utilizing the device to firm and shape the waist and lower thigh area.
Figure 14:
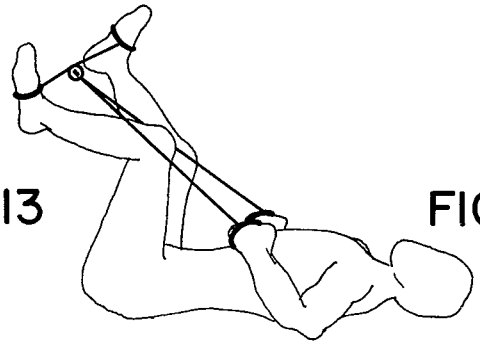
FIG. 14 illustrates an exercise utilizing the device to firm and shape the calves, thighs, buttock and abdominal muscle groups.
Figure 15:
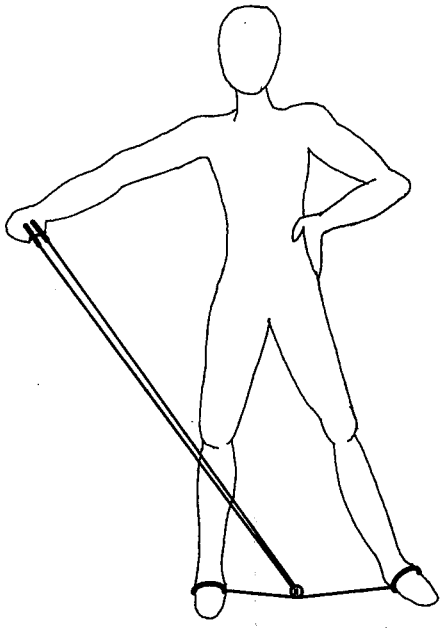
FIG. 15 illustrates an exercise utilizing the device to firm and shape the shoulder caps, neck muscle groups and deltoid muscles.
Figure 16:
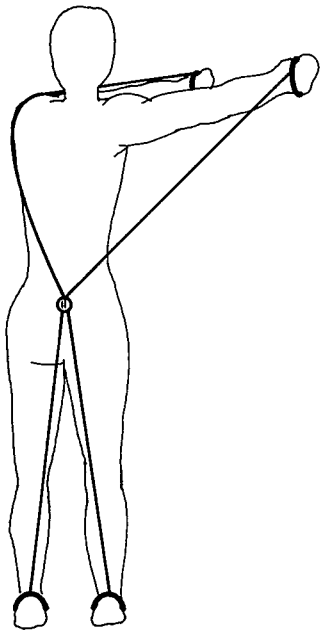
FIG. 16 illustrates an exercise utilizing the device that firms and shapes the waist, shoulders, and upper body group muscles.
Figure 17:
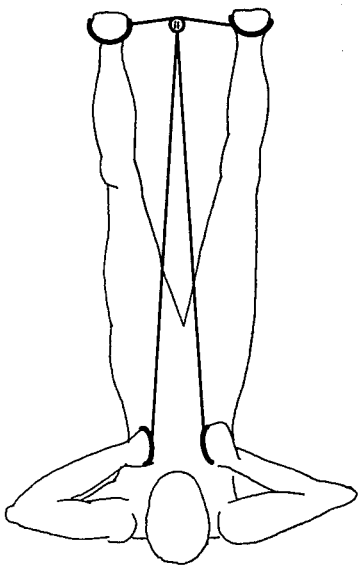
FIG. 17 illustrates an exercise utilizing the device to firm and shape the abdominal muscles and leg muscles.
Figure 18:
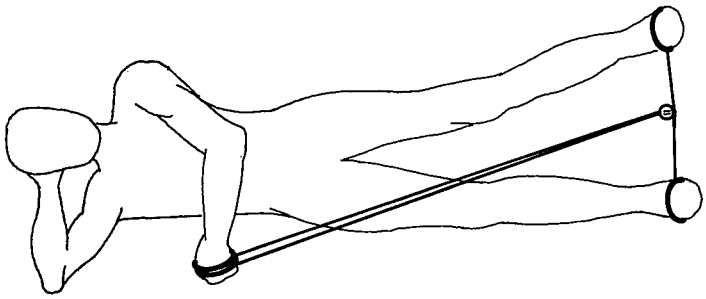
FIG. 18 illustrates an exercise utilizing the device for firming and shaping the upper thighs.
Figure 19:
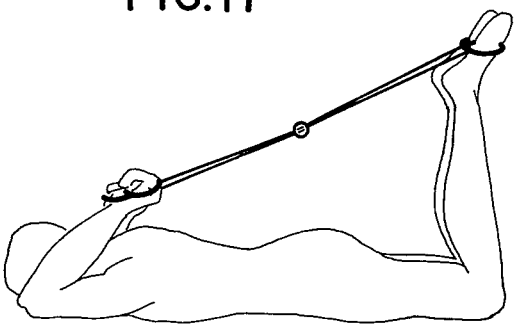
FIG. 19 illustrates another exercise utilizing the device for firming and shaping the lower back, buttocks and thigh areas.
Figure 20:
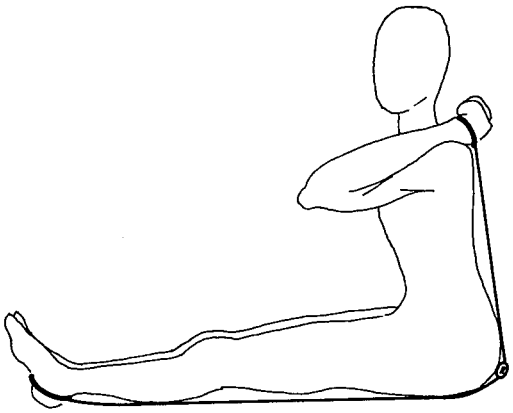
FIG. 20 illustrates yet another exercise utilizing the device for firming and shaping the abdominal muscle group.

Different exercises require different methods of use; however, the clip 3 can be adjustable for the proper location and tension for the exercise to be performed so that the user is free to exercise at the desired rate and level of resilient tension. As can be seen in FIG. 8, the slidable adjustable clip 3 allows individual tension adjustments for the various exercises to be employed.

The exercises depicted in FIGS. 3 through 20 are intended as exemplary of the great variety of exercises that can be performed with this device. Some exercises depicted in FIGS. 3 through 20 utilize the adjustable feature and others do not. It can readily be seen though, by viewing the exercises depicted in FIGS. 3 through 20 that the device is extremely versatile and allows wide variety of devices with a variety of exercise lengths and tensions.

Obviously, many modifications and variations of the present invention are possible in light of the above teaching. It is therefore to be understood that, within the scope of the appended claims, the invention may be practiced otherwise than as specifically described.

I claim:

1. A resistive exercise device comprising:

(a) a first resilient elongate member having a first free end and a second free end;

(b) a second resilient elongate member having a first free end and a second free end;

(c) handhold means affixed to said first end of said first member and handhold means affixed to said first end of said second member;

(d) foothold means affixed to said second end of said first member and foothold means affixed to said second end of said second member;

(e) adjustable friction type connector means receiving said elongate members in adjuxta position relationship and said connector means is slidably attached between said first end and said second end of said second member and said first end and said second end of said first member whereby the distance between said first ends and said connector means may be selectively varied in length so that various exercises may be performed when the handhold means and the foothold means are operated on simultaneously and wherein said adjustable connector means is operable independent of and also not connected to any external structure.

2. The resistive exercise device as described in claim 1 wherein the adjustable connector means is secured to said elongate members by friction.

3. The resistive exercise device as described in claim 2 wherein the adjustable connector means is comprised of a bent disc having a plurality of holes therethrough, wherein said elongate members pass through said holes.

4. The resistive exercise device as described in claim 3 wherein said bent disc is comprised of a semi-rigid material whereby the shape of said disc may be altered.

5. The resistive exercise device as described in claim 4 wherein the number of holes within the bend disc is two.

6. The resistive exercise device as described in claim 4 wherein the number of holes in the (flexible disc) bent disc is four.

* * * * *